United States Patent [19]

Joyce

[11] Patent Number: 4,820,119

[45] Date of Patent: Apr. 11, 1989

[54] INNER TURBINE SEAL

[75] Inventor: Michael J. Joyce, West Hartford, Conn.

[73] Assignee: United Technologies Corporation, Hartford, Conn.

[21] Appl. No.: 197,726

[22] Filed: May 23, 1988

[51] Int. Cl.[4] ..... F01D 11/02

[52] U.S. Cl. ..... 415/172 A; 277/193; 277/199

[58] Field of Search ..... 277/193, 194, 195, 198, 277/199; 415/172 A, 199.5, 170 R

[56] References Cited

U.S. PATENT DOCUMENTS

| | | | |
|---|---|---|---|
| 3,314,651 | 4/1967 | Beale | 415/172 A |
| 3,529,904 | 9/1970 | Scalzo et al. | 415/170 R |
| 3,941,500 | 3/1976 | Glenn | 277/53 |
| 4,426,087 | 1/1984 | Sargent et al. | 277/199 |
| 4,645,424 | 2/1987 | Peters | 415/172 A |
| 4,659,289 | 4/1987 | Kalogeros | 415/172 A |

FOREIGN PATENT DOCUMENTS

| | | | |
|---|---|---|---|
| 2198489A | 6/1988 | United Kingdom | 415/170 R |

*Primary Examiner*—William A. Cuchlinski, Jr.
*Assistant Examiner*—Jeffrey J. Hohenshell
*Attorney, Agent, or Firm*—Edward L. Kochey, Jr.

[57] ABSTRACT

An inner turbine seal is formed of a full annular vane platform structure (32) and a full annulus seal land structure (60). These two structures are splined together (48, 50, 64) and piston ring (70) seals against leakage between the two structures. Radial differential growth between the structures is permitted. Vane platform structure (32) may therefore be designed to minimize stresses in the vane area (26, 28) while seal land structure (60) may be designed to minimize leakage through knife edge seals (22, 62).

6 Claims, 2 Drawing Sheets

FIG. 1
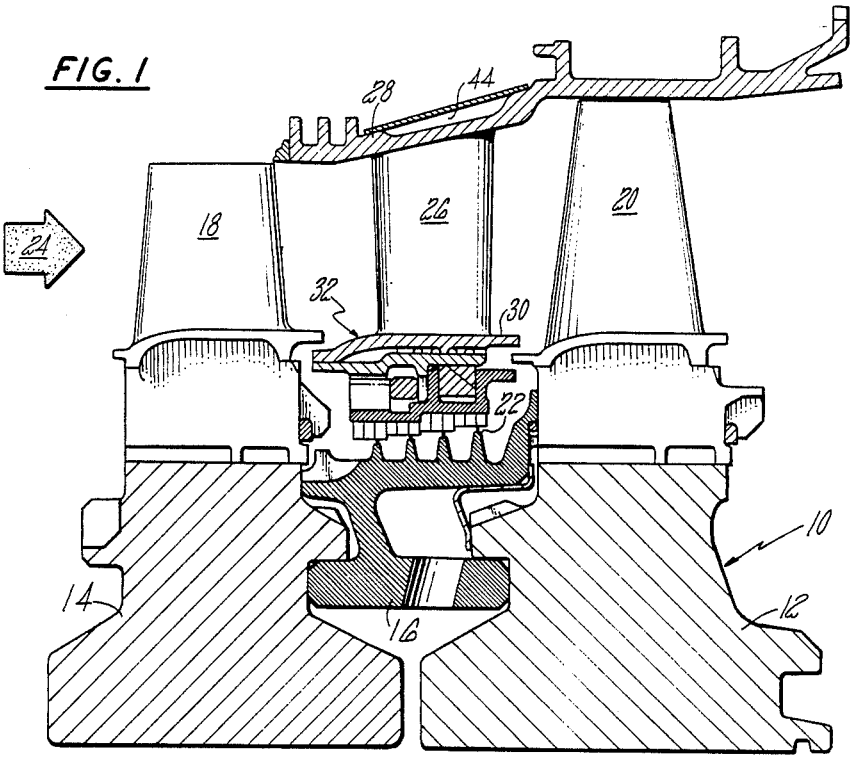
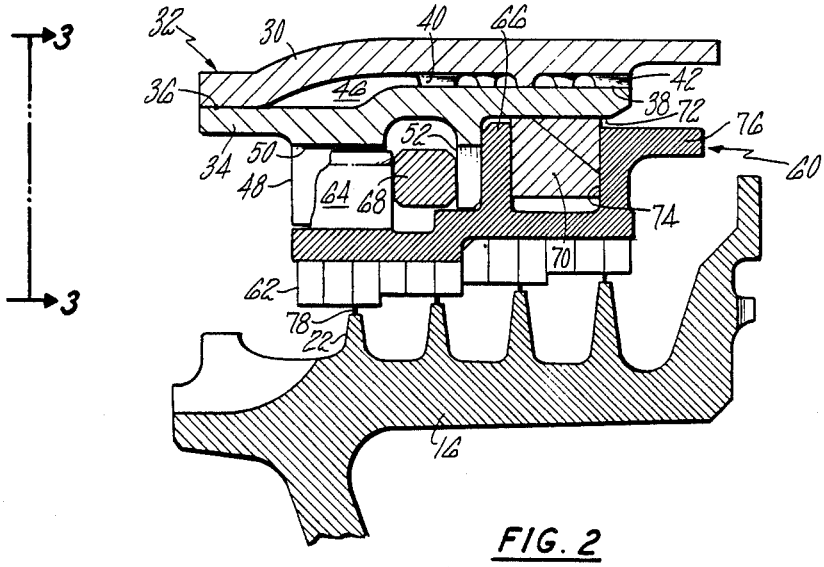
FIG. 2

INNER TURBINE SEAL

The Government has rights in this invention pursuant to a contract awarded by the Department of the Army.

TECHNICAL FIELD

The invention relates to gas turbine engines and in particular to a seal for limiting gas bypass around a stator stage.

BACKGROUND OF THE INVENTION

In gas turbine engines air is compressed and fuel burned in the high pressure air. This gas is then expanded through a gas turbine. Such a gas turbine has a plurality of alternate rotor stages for withdrawing energy and stator stages for redirecting the flow.

It is desirable that the entire gas flow pass through the stator stage to achieve the proper orientation upon entering the succeeding rotor stage. Gas bypassing the stator vanes represents a power and efficiency loss and therefore is to be minimized.

It is conventional to establish an inner shroud connecting the inner edge of all vanes. A seal between the shroud and the rotating rotor must be provided. Often circumferential knife edges on the rotor in close proximity to an abradable strip on the stator are used to restrict flow between the shroud and the rotor.

Segmented shrouds and segmented abradable strips have leakage therebetween and present sealing problems in attempting to minimize this leakage. Full annular shrouds are therefore desired for this purpose. A full annular inner shroud in conjunction with vanes secured thereto and the outer shroud of the turbine stage creates a relatively rigid structure. Temperature differentials existing throughout these components produce strains which must be absorbed. Such strains may be minimized by modifying expansion by use of appropriate amounts of cooling air to the selected components. In conventional construction such growth change for the purpose of limiting the strain of these components can lead to additional leakage past the inner shroud.

Over the operating range of the gas turbine varying steady state and transient temperature distributions occur in the various components. Minimum leakage is obtained with freedom to choose material with the desired coefficient of expansion and predicted expansion. Improved design results may be obtained if this problem can be divorced from the strain problem of the vanes and the bounding shrouds. Segmented rings can have relative movement between the segments and therefore the expansion is less predictable than it would be on a full annular ring.

SUMMARY OF THE INVENTION

An inner turbine seal has both a full annulus vane platform structure and a full annulus seal land structure. These two structures are splined together preventing relative rotation. An abutment surface between the two prevents relative axial movement in one direction while a locking ring between the two prevents axial movement in the other direction. A piston ring interposed between the two structures seals against gas bypass between the vane platform structure and the seal land structure.

A full annulus seal land is provided on the seal land structure for interfacing with turbine rotor knife edges. Radial growth of the vane platform structure may be selected and regulated to minimize stresses in the vane assembly while the seal land structure may be independently designed and regulated to minimize clearance between the seal land and the rotor. The piston ring continues to seal against bypass independent of the differential growth between the vane platform structure and the seal land structure.

BRIEF DESCRIPTION OF THE DRAWINGS

FIG. 1 is an axial section through a gas turbine showing the stator vanes and inner seal assembly;

FIG. 2 is an expanded axial section showing the inner seal assembly; and

DESCRIPTION OF THE PREFERRED EMBODIMENT

Figure 3:
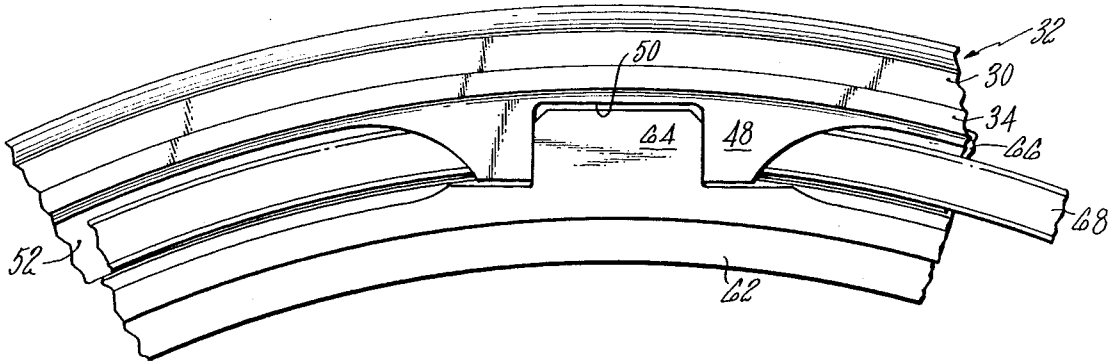
FIG. 3 is a transverse section of the inner seal assembly.

Turbine rotor 10 includes rotor disks 12 and 14 and spacer assembly 16. The rotor carries the rotating turbine blades 18 and 20.

The spacer assembly 16 carries a plurality of circumferential knife edges 22. These are for the purpose of sealing against gas flow thereby. A flow of hot turbine gas 24 passes over blades 18 past vanes 26 and thereafter over blades 20. It is desirable that the amount of gas bypassing vanes 26 is minimized.

The vanes 26 are brazed to a full annulus outer shroud 28 and to a full annulus blade platform 30. A vane platform structure 32 is formed of the blade platform 30 and an inner platform structure 34. These components are brazed together at locations 36 and 38 and have a series of metal protrusions 40 expending therebetween as well as air flow outlets 42 located selectively around the circumference.

Cooling air is directed from plenum 44 in the outer shroud through openings in the vanes. A portion of the air continues to plenum 46 between components 30 and 34 and out through opening 42. This provides selective cooling of the vane platform structure. Such cooling air flow is selected and regulated throughout the operating range of the gas turbine to minimize differential thermal growth of the components thereby minimizing strain and locked in stresses. The component 34 is of a cobalt alloy material having a higher coefficient of expansion than the Inconel nickel alloy material of which vane platform 30 is made. Since the vane platform 30 is operating at a higher temperature during normal operation than component 34, this results in a tendency to achieve common expansion of the two components minimizing forces on the brazed joint.

The component 34 has an inwardly extending structure 48 forming spline grooves 50. It also contains an inwardly extending ring 52 throughout the full circumference except for selected openings as described hereinafter.

A seal land structure 60 is a full annulus carrying a full annulus abradable seal land 62. The structure carries a plurality of splines 64 which engage grooves 50 for the purpose of preventing relative rotation of vane platform structure 32 and seal land structure 60. An outwardly extending ring 66 bears against ring 52 to limit movement of the seal land structure in the upstream direction.

A locking ring 68 is formed of a plurality of arcuate segments which are slid into place after the vane platform structure and seal land structure are assembled. This ring operates against the upstream face of ring 52 and the downstream edge of splines 64 to prevent movement of the seal land structure in a downstream direction.

Ring 52 has openings at selected locations for the purpose of permitting spline 64 to pass therethrough during assembly.

A piston ring 70 is located to seal against surface 72 of the vane platform structure and surface 74 of the seal platform land structure.

The seal land ring 76 of the seal land structure is formed of a low expansion nickel alloy so that its growth during the operating range more closely approximates that of the lower operating temperature rotor 16.

It can be seen that the vane platform structure may be selected of materials to facilitate the design of the vanes and attached structure while the seal land structure may be selected of a material best selected to minimize clearances 78 between knife edges 22 and the abradable seal land 62. The piston ring 70 operates to provide sealing between the two structures although they may expand radially different amounts.

I claim:

1. An inner turbine seal for sealing a turbine stator stage and a rotor from gas bypass around said stator stage comprising:

a full annulus vane platform structure;

a plurality of stator vanes secured to said vane platform structure and extending radially outward therefrom;

a full annulus seal land structure located coaxially inside said vane platform structure;

a plurality of axially extending spline grooves on one of said vane platform structure and seal land structure;

a plurality of axially extending splines engaging locking means for axially restraining relative axial movement of said vane platform structure and seal land structure;

a piston ring sealingly engaging both said vane platform structure and said seal land structure; and said seal land structure including a full annulus abradable seal land around the inner periphery thereof located in flow sealing proximity to said rotor.

2. An inner turbine seal as in claim 1, said locking means comprising:

a radially inwardly extending first ring on said vane platform structure;

a radially outwardly extending second ring on said seal land structure;

said first and second rings in axial contact, whereby relative axial movement of said vane platform structure and said seal land structure in a first direction is prevented; and blocking means between said first ring and the splines of said seal land structure, whereby relative axial movement in a direction opposite the said first direction is prevented.

3. An inner turbine seal as in claim 2, said blocking means comprising:

a circumferentially slidable insert.

4. An inner turbine seal as in claim 3:

said circumferentially slidable insert comprising a plurality of arcuate segments forming in total a full circumferential insert.

5. An inner turbine seal as in claim 1:

said first ring segmented with radial slots in said ring;

said radial slots arranged and spaced to pass the splines of said seal land structure during assembly.

6. An inner turbine seal as in claim 1:

said turbine seal having an upstream side and a downstream side with respect to gas flow past said vanes;

said seal land structure having a radially outwardly extending seal ring; and said piston ring in sealing contact with the upstream side of said seal ring.

* * * * *